US007568898B2

(12) United States Patent
Shoulders

(10) Patent No.: US 7,568,898 B2
(45) Date of Patent: Aug. 4, 2009

(54) COMPRESSOR SOUND SUPPRESSION

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 11/813,769

(22) PCT Filed: Mar. 7, 2005

(86) PCT No.: PCT/US2005/007595

§ 371 (c)(1),
(2), (4) Date: Jul. 12, 2007

(87) PCT Pub. No.: WO2006/096178

PCT Pub. Date: Sep. 14, 2006

(65) Prior Publication Data

US 2008/0038121 A1 Feb. 14, 2008

(51) Int. Cl.
*F03C 2/00* (2006.01)
*F03C 4/00* (2006.01)

(52) U.S. Cl. ..... 418/201.2; 418/201.1; 418/181; 418/270; 417/295; 417/312

(58) Field of Classification Search ..... 418/201.1, 418/201.2, 159, 270, DIG. 1, 181; 417/295, 417/312; 181/403, 254, 237, 229
See application file for complete search history.

(56) References Cited

U.S. PATENT DOCUMENTS

| | | | | |
|---|---|---|---|---|
| 4,062,199 | A * | 12/1977 | Kasahara et al. | 418/201.2 |
| 4,781,545 | A | 11/1988 | Yokomizo et al. | |
| 5,208,429 | A | 5/1993 | Field | |
| 6,312,232 | B1 * | 11/2001 | Mori et al. | 417/297 |
| 2004/0040322 | A1 * | 3/2004 | Engel et al. | 62/505 |

* cited by examiner

*Primary Examiner*—Theresa Trieu
(74) *Attorney, Agent, or Firm*—Bachman & LaPointe, P.C.

(57) ABSTRACT

A compressor apparatus has a housing (22) having first (53) and second (58) ports along a flowpath. One or more working elements (26, 28) cooperate with the housing to define a compression path between suction and discharge locations along the flowpath. A check valve (70) has a valve element having a first condition permitting downstream flow along the flowpath and a second condition blocking a reverse flow. Sound suppressing means (120, 220, 320) at least partially surround the flowpath upstream of the valve element (70).

18 Claims, 4 Drawing Sheets

COMPRESSOR SOUND SUPPRESSION

BACKGROUND OF THE INVENTION

The invention relates to compressors. More particularly, the invention relates to compressors having check valves.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port. The compression pocket opening and closing (particularly discharge port opening) are associated with pressure pulsations and resulting sound. Sound suppression has thus been an important consideration in compressor design. Many forms of compressor mufflers have been proposed.

Additionally, various transient conditions may tend to cause reverse flow through the compressor. For example, upon a power failure or other uncontrolled shutdown high pressure refrigerant will be left in the discharge plenum and downstream thereof in the refrigerant flowpath (e.g., in the muffler, oil separator, condenser, and the like). Such high pressure refrigerant will tend to flow backward through the rotors, reversing their direction of rotation. If rotation speed in the reverse direction is substantial, undesirable sound is generated. For some screw compressors, damage to mechanical components or internal housing surfaces can also occur. Accordingly, a one-way valve (a check valve) may be positioned along the flowpath to prevent the reverse flow. Other forms of compressor (e.g., scroll and reciprocating compressors) may include similar check valves.

SUMMARY OF THE INVENTION

A compressor apparatus has a housing having first and second ports along a flowpath. One or more working elements cooperate with the housing to define a compression path between suction and discharge locations along the flowpath. A check valve has a valve element having a first condition permitting downstream flow along the flowpath and a second condition blocking a reverse flow. Sound suppressing means at least partially surround the flowpath upstream of the valve element.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
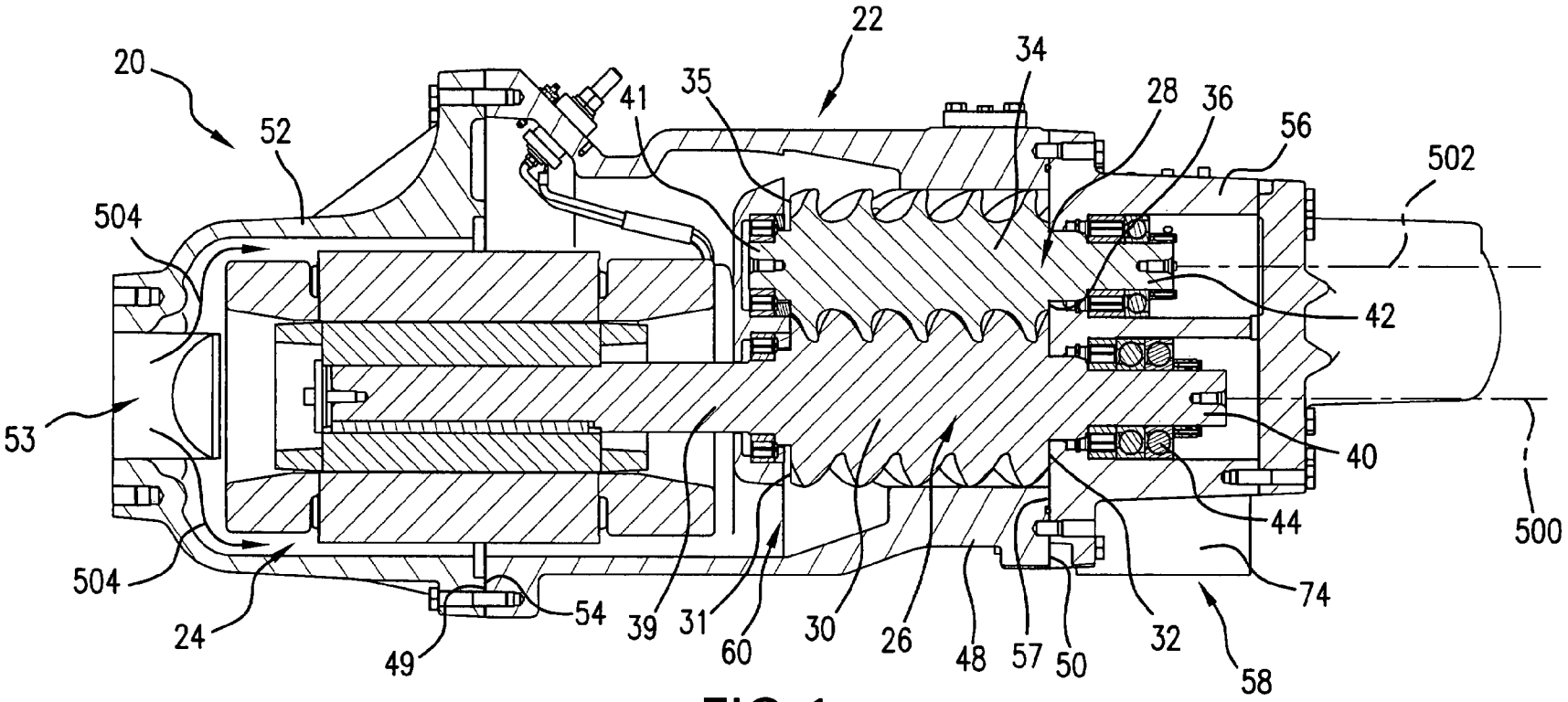
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet housing 56 (specifically the discharge case) (shown as an assembly) having an upstream face 57 mounted to the rotor housing downstream face and having an outlet/discharge port 58. The exemplary rotor housing, motor/inlet housing, and outlet housing 56 may each be formed as castings subject to further finish machining.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62. A pair of male and female compression pockets is formed by the housing assembly 22, male rotor body 30, and female rotor body 34. In the pair, one such pocket is located between a pair of adjacent lobes of each associated rotor.

Figure 2:
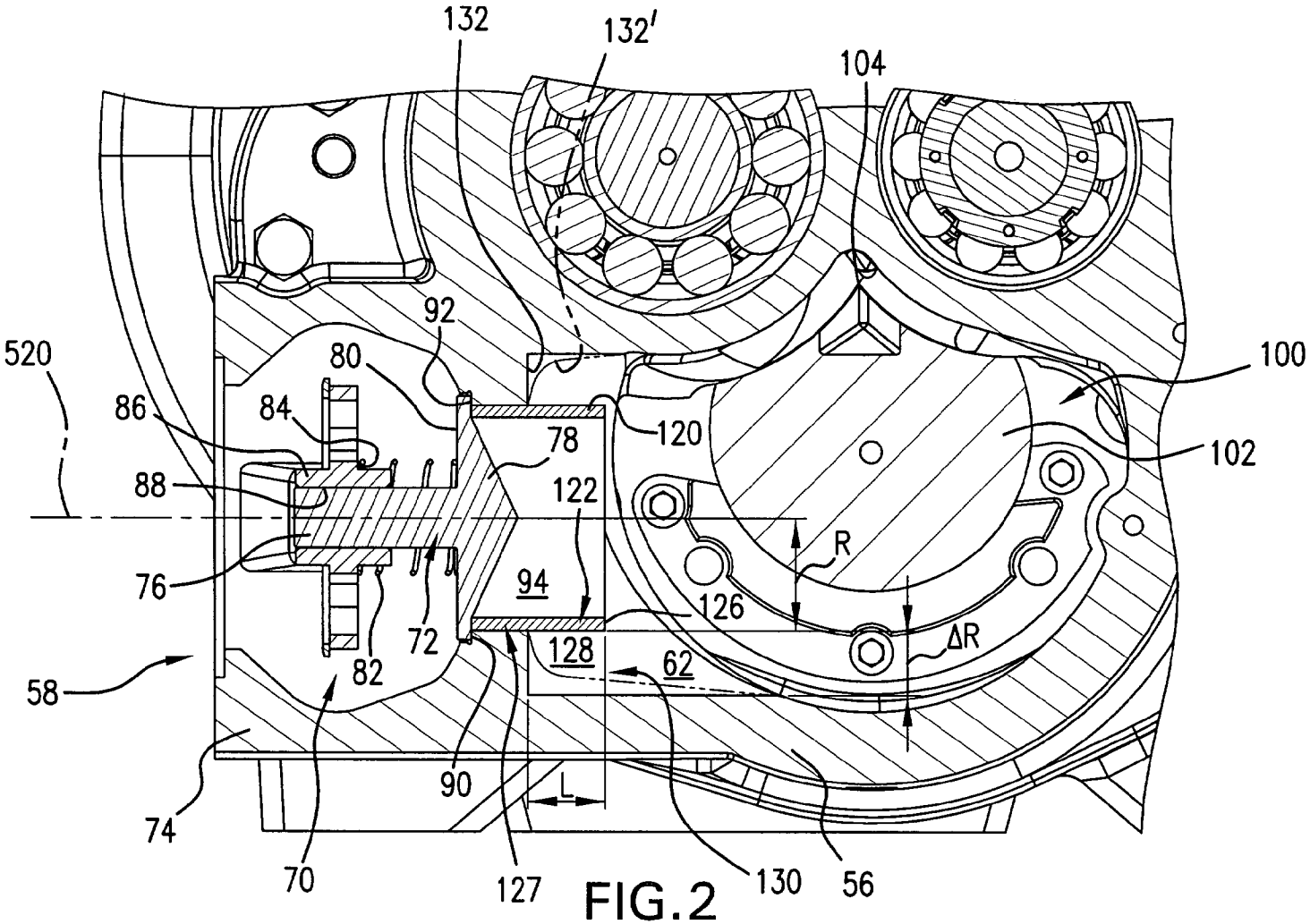
FIG. 2 is a partial sectional view of a discharge housing of the compressor of FIG. 1 including a first sound suppressing means.

FIG. 2 shows further details of the exemplary flowpath at the outlet/discharge port 58. A check valve 70 is provided having a valve element 72 mounted within a boss portion 74 of the outlet housing 56. The exemplary valve element 72 is a front sealing poppet having a stem/shaft 76 unitarily formed with and extending downstream from a head 78 along a valve axis 520. The head has a back/underside surface 80 engaging an upstream end of a compression bias spring 82 (e.g., a metallic coil). The downstream end of the spring engages an upstream-facing shoulder 84 of a bushing/guide 86. The bushing/guide 86 may be unitarily formed with or mounted relative to the housing and has a central bore 88 slidingly accommodating the stem for reciprocal movement between an open condition (not shown) and a closed condition of FIG. 3. The spring 82 biases the element 72 upstream toward the closed condition. In the closed condition, an annular peripheral seating portion 90 of the head upstream surface seats against an annular seat 92 at a downstream end of a port 94 from the discharge plenum.

For capacity control/unloading, the compressor has a slide valve 100 having a valve element 102. The valve element 102 has a portion 104 along the mesh zone between rotors. The exemplary valve element has a first portion at the discharge plenum and a second portion at the suction plenum. The valve element is shiftable to control compressor capacity to provide unloading. The exemplary valve is shifted via linear translation parallel to the rotor axes.

The opening and closing of the compression pockets at suction and discharge ports produce pressure pulsations. As the pulsations propagate into the gas in the discharge plenum and downstream thereof, they cause vibration and associated radiated sound which are undesirable. This pulsation may be at least partially addressed by modifications involving the discharge plenum upstream of the check valve. Exemplary modifications involve modifications to the discharge plenum at the port 94 to incorporate one or more resonators tuned to suppress/attenuate one or more sound/vibration frequencies at one or more conditions. An exemplary frequency is that of the compression pockets opening/closing at the designed compressor operating speed and at the designed refrigeration system operating condition. Thus examples of otherwise identical compressors may feature differently-tuned resonators for use in different systems or conditions thereof. Exemplary modifications make use of existing manufacturing techniques and their artifacts. Exemplary modifications may be made in a remanufacturing of an existing compressor or a reengineering of an existing compressor configuration. An iterative optimization process may be used to tune the resonator(s).

FIG. 2 shows one exemplary modification of a basic compressor. This modification involves providing an outlet conduit 120 having a distal/upstream protruding portion 122 extending into the discharge plenum to a rim 126. In the exemplary implementation, the outlet conduit is separately formed from the remainder of the outlet housing (e.g., as a steel cylindrical tube having a proximal/downstream portion 127 interference fit (e.g., press-fit) into a cast iron housing member 56 within 2 cm of the head 78 in the second (closed) condition). An annular channel 128 is defined in the discharge plenum surrounding the protruding portion 122 to form an annular resonance cavity that functions as a side branch resonator. The exemplary cavity has an annular opening/port 130. When implemented in a remanufacturing of an existing compressor or a reengineering of an existing configuration, the cavity may be associated with a change in the local discharge plenum surface 132 (e.g., from an initial/baseline surface 132'). In the exemplary implementation, the surface is relieved so as to deepen and broaden the cavity. The cavity is shown having a length L, an inner radius R, and a radial span ΔR. These parameters may be selected to provide desired tuning. The annular base portion of the surface 132 forms a back wall of the cavity, off which pressure waves reflect. The length L may thus be chosen to provide an out-of-phase cancellation effect relative to incident pulsations at the plane of the port 130 and rim 126. The cancellation effect reduces pulsation magnitude at the conduit mouth and, in turn, downstream through the conduit. By changing the curved section of the baseline surface 132' to the more right angle section of the surface 132, a flat radial back wall/base is formed that provides a more coherent reflection, permitting advantageous cancellation properties.

Figure 3:
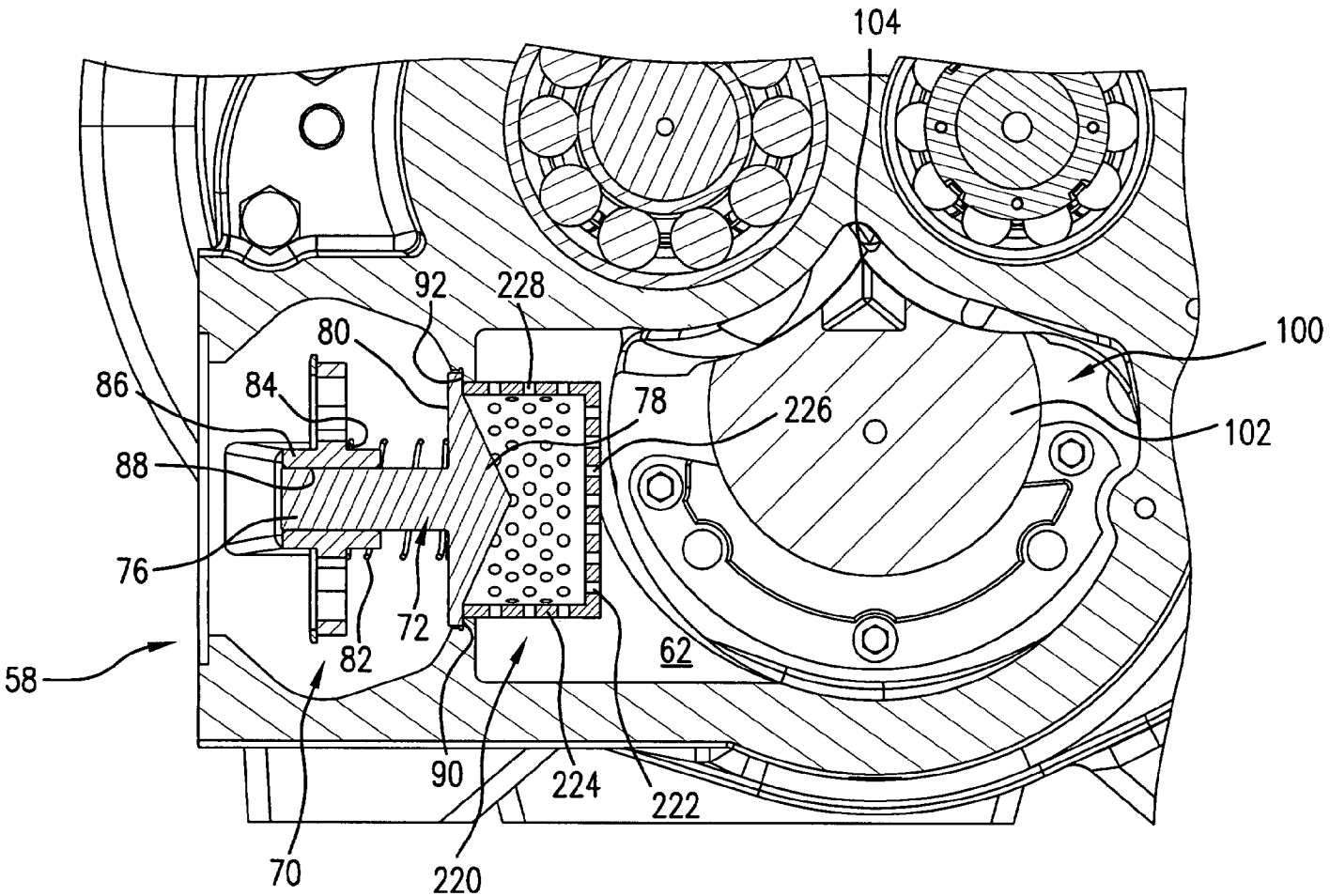
FIG. 3 is a partial sectional view of a discharge housing of the compressor of FIG. 1 including a second sound suppressing means.

FIG. 3 shows an alternative modification wherein the outlet conduit 220 has an upstream end wall 222 and a sidewall 224. The end wall 222 includes an array of apertures 226. The sidewall 224 includes an array of apertures 228. The apertures 226 and 228 serve to break-up the discharge flow into many substreams passing through the aperture and recombining in the interior of the conduit 220. This helps attenuate the downstream impact of upstream pulsations. The sizes, densities, and distributions of the apertures may be selected to provide a desired degree of attenuation. Optionally, there may be some tuning of the plenum volume surrounding the conduit 220 to also provide additional pulsation reduction within the conduit 220.

Figure 4:
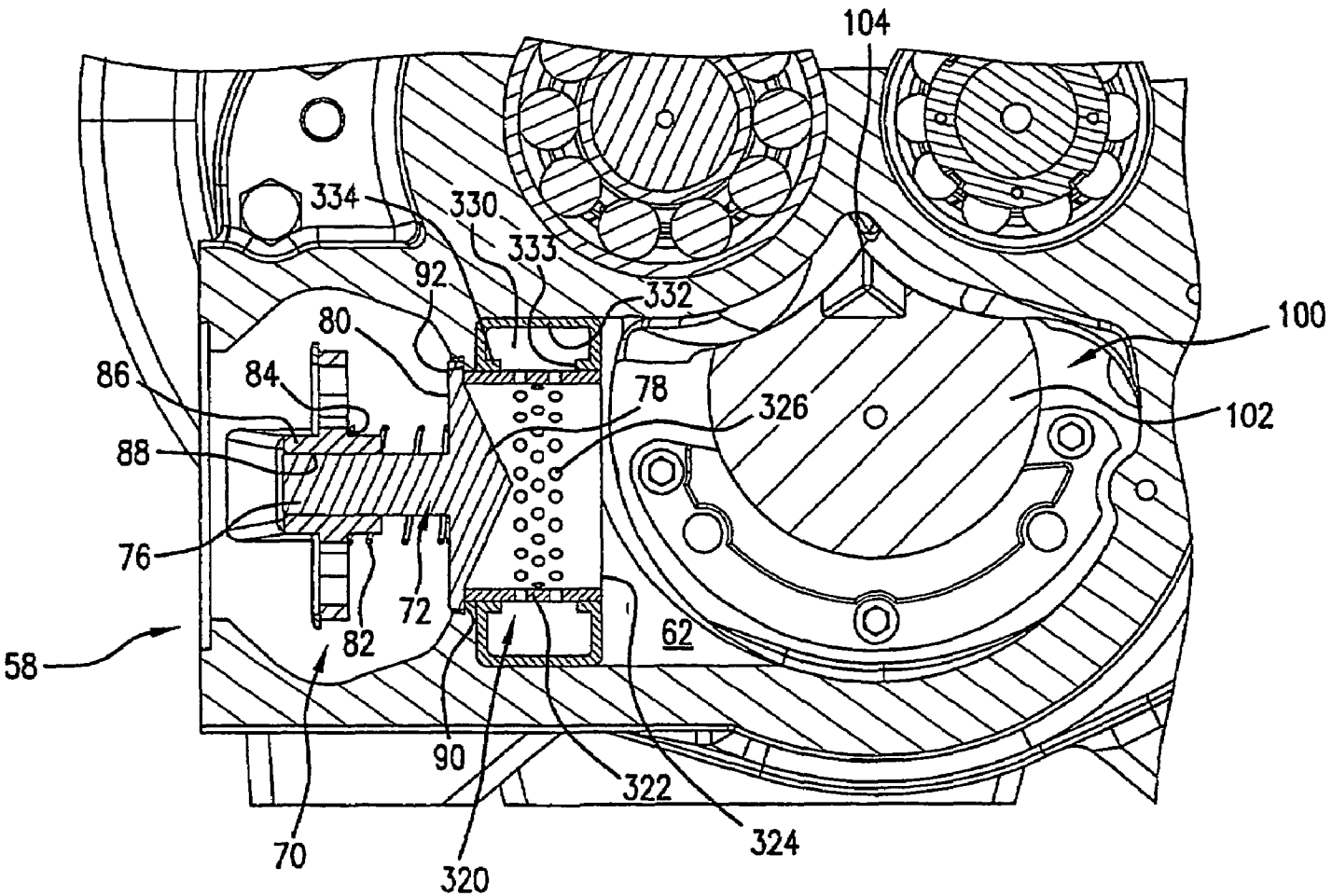
FIG. 4 is a partial sectional view of a discharge housing of the compressor of FIG. 1 including a third sound suppressing means.

FIG. 4 shows another alternative modification wherein an outlet conduit assembly 320 has a main conduit 322 extending downstream from a rim 324. Although optionally similarly constructed to the conduit 120, the conduit 322 has an array of apertures 326 similar to the apertures 228 of the conduit 220. However, rather than passing a net flow, the apertures 326 serve as ports to a resonator volume 330 surrounding the conduit. The volume 330 is otherwise sealed and longitudinally and laterally bounded by an inwardly-open C-sectioned member 332 (e.g., having a pair of upstream and downstream collars 333 and 334 welded to the outboard surface of the conduit 322). Thus, although similarly located to the resonator volume 128, the resonator volume 330 has a longitudinal and circumferential array of discrete radial ports provided by the apertures 326 rather than a single annular longitudinal port 130. Optionally, the volume 330 may be filled with a sound dissipating material. The presence of that dissipative material may reduce cancellation effectiveness at a single target frequency but compensate by providing some cancellation over a wider frequency range, making tuning accuracy less critical.

The relative proximity of the resonator(s) to the discharge plenum is believed advantageous for several reasons. First, flow turbulence may tend to increase downstream. Turbulent conditions make tuning difficult. The relatively low turbulence of an upstream location (e.g., within the compressor housing), helps facilitate proper tuning. Second, the proximity to the pulsation source may maximize the sound/vibration cancellation effect.

Many known or yet-developed resonator configurations and optimization techniques may be applied. The former include, for example, Helmholtz resonators.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Implementations may involve check valves used in other locations in the fluid circuit. The principles may be applied to compressors having working elements other than screw-type rotors (e.g., reciprocating and scroll compressors). Accordingly, other embodiments are within the scope of the following claims.

What is claimed is:

1. A compressor apparatus (20) comprising:

a housing (22) assembly having first (53) and second (58) ports along a flow path and including a cast discharge case (56);

one or more working elements (26; 28) cooperating with the housing (22) to define a compression path between a suction (60) plenum and a discharge (62) plenum along the flow path, wherein the one or more working elements include:

a screw-type male-lobed rotor (26) having a first rotational axis (500); and a screw-type female-lobed rotor (28) having a second rotational axis (502) and enmeshed with the male-lobed rotor;

a check valve (70) in the discharge case and having a valve element (72) having a first condition permitting downstream flow along the flow path and a second condition blocking a reverse flow; and sound suppressing means (120; 220; 320) at least partially surrounding the flow path upstream of the valve element.

2. The compressor of claim 1 wherein:

the sound suppressing means comprises a rigid conduit (120; 220; 322) having a first portion (127) secured to the discharge case and a second portion (122) extending away from the check valve.

3. The compressor of claim 2 wherein:

the conduit (120; 322) has a completely open upstream end.

4. The compressor of claim 2 wherein:

the conduit (220) has:

a partially closed upstream end (222) having a plurality of ports (226); and a sidewall (224) having a plurality of longitudinally and circumferentially spaced ports (228).

5. The compressor of claim 2 wherein:

the conduit (120; 220; 322) has a right circular cylindrical sidewall (120; 224; 322).

6. The compressor of claim 2 wherein:

a volume (128; 330) encircling the conduit (120; 220; 322) forms a resonator.

7. The compressor of claim 6 wherein:

the resonator has a port (130) surrounding a distal end of the conduit.

8. The compressor of claim 6 wherein:

the resonator has a plurality of ports, longitudinally and circumferentially spaced along the conduit.

9. The compressor of claim 1 wherein:

the valve element (72) has an upstream head (78) and a downstream stem (76).

10. The compressor of claim 9 wherein:

the sound suppressing means comprises a conduit (120; 220; 322) interference fit in the discharge case (56) within 2 cm of the head (78) in the second condition.

11. The compressor of claim 1 wherein:

the sound suppression means comprises a branch resonator.

12. A screw compressor comprising:

a housing having first and second ports along a flow path;

a screw-type male-lobed rotor (26) having a first rotational axis (500);

a screw-type female-lobed rotor (28) having a second rotational axis (502) and enmeshed with the male-lobed rotor and cooperating with the male-lobed rotor and the housing to define a compression path along said flow path; and a sound suppressing element having a conduit (120; 220; 322) having a first portion interference fit in a discharge case member of the housing and a second portion extending upstream from the first portion along said flow path.

13. The compressor of claim 12 wherein the conduit comprises a metallic right circular cylindrical tube.

14. The compressor of claim 12 wherein the conduit cooperates with a portion of the discharge case member to define a resonator.

15. The compressor of claim 12 further comprising:

a check valve (70) in the discharge case and having a valve element (72) having a first condition permitting downstream flow along the flow path and a second condition blocking a reverse flow, the valve element (72) downstream of the conduit along the flow path.

16. A compressor apparatus (20) comprising:

a housing (22) assembly having first (53) and second (58) ports along a flow path and including a cast discharge case;

one or more working elements (26; 28) cooperating with the housing (22) to define a compression path between a suction (60) plenum and a discharge (62) plenum along the flow path; and a check valve (70) in the discharge case and having a valve element (72) having a first condition permitting downstream flow along the flow path and a second condition blocking a reverse flow; and sound suppressing means (120; 220; 320) at least partially surrounding the flow path upstream of the valve element wherein a volume (128; 330) encircling the conduit (120; 220; 322) forms a resonator having a plurality of ports (228, 326), longitudinally and circumferentially spaced along the conduit.

17. A compressor apparatus (20) comprising:

a housing (22) assembly having first (53) and second (58) ports along a flow path and including a cast discharge case;

one or more working elements (26; 28) cooperating with the housing (22) to define a compression path between a suction (60) plenum and a discharge (62) plenum along the flow path; and a check valve (70) in the discharge case and having a valve element (72), the valve element having an upstream head (78) and a downstream stem (76) and having a first condition permitting downstream flow along the flow path and a second condition blocking a reverse flow; and sound suppressing means (120; 220; 320) at least partially surrounding the flow path upstream of the valve element.

18. The compressor of claim 17 wherein:

the sound suppressing means comprises a conduit (120; 220; 322) interference fit in the discharge case within 2 cm of the head (78) in the second condition.

* * * * *